United States Patent [19]

Moeller

[11] Patent Number: 4,993,652

[45] Date of Patent: Feb. 19, 1991

[54] CONTINUOUS WINDER FOR WEB MATERIALS

[75] Inventor: Robert F. Moeller, Baldwinsville, N.Y.

[73] Assignee: The Black Clawson Company, Middletown, Ohio

[21] Appl. No.: 432,109

[22] Filed: Nov. 6, 1989

[51] Int. Cl.[5] ..... B65H 19/20; B65H 54/71

[52] U.S. Cl. ..... 242/56 A; 242/56 R

[58] Field of Search ..... 242/56 A, 56 R, 58.1, 242/58.2, 58.3, 58.4

[56] References Cited

U.S. PATENT DOCUMENTS

| | | | |
|---|---|---|---|
| 4,153,215 | 5/1979 | Schulze | 242/56 A |
| 4,171,780 | 10/1979 | Bugnone | 242/56 A |
| 4,175,114 | 11/1979 | Dreher | 242/56 R X |
| 4,609,162 | 9/1986 | Kataoka | 242/56 R |

*Primary Examiner*—William A. Cuchlinski, Jr.
*Assistant Examiner*—Joseph A. Rhoa
*Attorney, Agent, or Firm*—Biebel, French & Nauman

[57] ABSTRACT

A continuous winder for web material includes two pairs of turret arms mounted for rotation with respect to each other on a common axis, and also includes a lay-on roll mounted for lateral movement toward and away from the axis of the turret arms. The lay-on roll maintains pressure engagement with the winding roll until the interval of actual roll changing, when it moves from the wound roll into pressure engagement with the new core with the web running therebetween, whereupon the web is cut between the two rolls to complete the roll change. The knife assembly for cutting the web is carried by another pair of pivotally mounted arms and includes a clamp mechanism on each arm which effects rotatable clamping engagement with the adjacent turret arm carrying the new core so that the knife arms and the core-carrying turret arms travel together throughout the actual operation of roll changing and thereby assure that the knife is held in proper relation with the core before the roll change is made and while it is being made.

12 Claims, 10 Drawing Sheets

CONTINUOUS WINDER FOR WEB MATERIALS

BACKGROUND OF THE INVENTION

This invention relates to the continuous winding of web materials, and particularly of thin plastic films such as stretch wrap and cling wrap films, as well as of paper, paperboard and other web type materials. In the continuous winding of such web materials, it is extremely important to maintain control over the tension in the web throughout as much as possible of the winding process, and particularly during the change from a full roll to a new core. This is particularly true with respect to the portion of the web which becomes the outer wraps on each full roll, and which, in the absence of proper tension control during roll changing, often becomes "tail waste" due to air entrainment between the outer web wraps that produces wrinkles, bunching, telescoping or skewing in this outermost portion of the roll.

Two co-owned patents disclose improvements of this aspect of continuous winding. The first of these patents Phelps et al U.S. Pat. No. 3,841,577, discloses a continuous winder wherein the full roll and the new core are each carried by a separate pair of turret arms that are mounted for rotation independently of each other and thus can be separately indexed to the various positions which they occupy during core loading, roll changing and the removal of a full roll.

The second such patent is Tetro U.S. Pat. No. 4,431,140, which discloses a turret-type winder wherein the winding roll and the new core are mounted at the opposite ends of a pair of rotationally mounted turret arms. Each of these turret arms also is provided with a rider roll which is carried by arms pivotally mounted on the turret arms for minimizing the amount of entrapped air between each winding wrap and thereby controlling the wound destiny of the roll. However, because the turret arms cannot be indexed with respect to each other, the angular distance through which they must rotate in the course of a roll change, as well as the distance between the new core and the full roll, are fixed and thus correspondingly affect web tension during roll changing.

A third co-owned patent, Tetro U.S. Pat. No. 4,422,586, discloses a continuous winder wherein severing the web at the time of roll changing is effected by a knife which is stationary at the instant when the web is being cut off, with the web being drawn across the knife edge immediately after it is affixed to the new core in order to cut the web at a location as close as possible to the new core. These provisions for severing the web do materially contribute to shortening the length of web upstream from the core, and thus the possibilities of folding back of the web at the start of the new roll, but otherwise the winder of this patent provides no control over the trailing portion of the web on the previous full roll other than is provided in Tetro U.S Pat. No. 4,431,140.

Thus while each of the above patents discloses a continuous winder which offers improvements over the art prior thereto from the standpoint of control of the tension in the web material during roll changing and correspondingly improving the properties of the successive wound rolls, there remains a need for a continuous winder which will still further reduce the length of the tail section of web that remains to be wound on the full roll after the web is cut, and which will also consistently reduce to a minimum the amount of web material between the cut leading end of the web and the area of web which is adhered to the new core at the start of a new roll.

SUMMARY OF THE INVENTION

The present invention fills that need by providing a continuous winder that is similar in some respects to the winder disclosed in the above U.S. Pat. No. 3,841,577, in that it includes two pairs of turret arms which are mounted for rotation with respect to each other on a common axis through 360°, and which can be separately indexed about that axis. Each of these pairs of arms occupies the same predetermined angular position during the majority of the period of winding a full roll on a core carried thereby. This roll winding position for each pair of arms is an intermediate position within a roll changing zone defined by angularly spaced positions of the two pairs of arms which are on opposite sides, angularly, of the winding position and which are relatively closely spaced, e.g. less than 90°.

A single lay-on or rider roll is mounted for transverse movement within the roll changing zone of the two pairs of arms for the purpose of pressing the web against the new core while the roll change is being carried out and also for maintaining that pressure as the new roll is wound into a full roll. Only during the interval of actual roll changing does this rider roll move from the full roll into pressure engagement with the new core with the web running therebetween, whereupon the web is cut between the two rolls to complete the roll change. This operation has been timed to require no more than one second, which results in a correspondingly very short length of web as the tail of the full roll that was not pressured against the full roll during winding thereon. The rider roll may be an idler roll which is driven by the web and by surface contact with each winding roll, but it is preferably provided with its own drive.

Another feature of the invention, which also contributes to effecting maximum control of the web during roll changing, is provided by novel structural and operational characteristics of the knife assembly, and particularly by the cooperative action of the knife assembly and the arms carrying each successive new core during roll changing. More specifically, the knife assembly includes a pair of arms which are mounted for rotational movement on a common axis spaced from and parallel with the axis of the turret arms, and which move through a path overlapping the path of each core sindle through the roll changing zone.

During roll changing, the knife assembly arms rotate in the opposite direction from the turret arms, and the knife assembly includes a clamp mechanism on each of the knife arms which effects rotatable clamping engagement with the adjacent turret arm about the axis of the spindle and the core carried thereby. This clamping relationship between the knife arms and the turret arms is maintained throughout the actual operation of roll changing, and this causes the knife to be held in predetermined relation with the core before the roll change is made and while it is being made.

In the preferred embodiment of the invention, each successive new core has a strip of adhesive extending lengthwise thereof, and when the turret arms are indexed to cause the pressure roll to move from the full roll to the new core, the web is pressed into adhesive engagement with the core. This in turn causes the web to be drawn across the edge of the knife at a location on the web so close to the adhesive area on the core as to leave a minimal tail of web material and thereby to minimize the possibility of fold-back on the core as the new roll starts to wind thereon.

Specific means which provide these features of the invention, and other objects and advantages of the invention will be apparent from or pointed out in the course of the description of the preferred embodiment which follows.

DESCRIPTION OF THE PREFERRED EMBODIMENT

Figure 1:
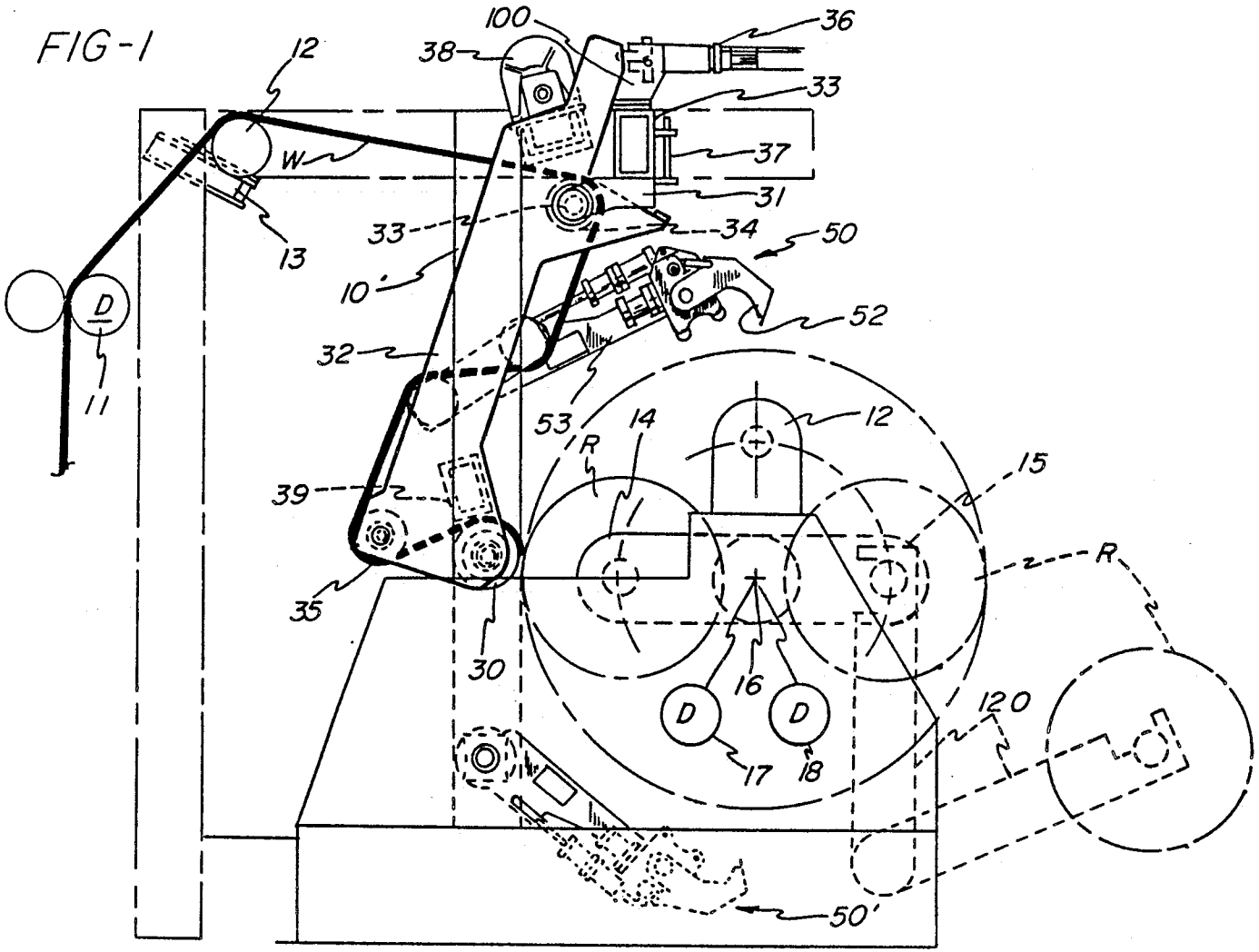
FIG. 1 is a somewhat diagrammatic view in side elevation illustrating the front side of a continuous winder in accordance with the invention, and particularly illustrating that stage of operation while a new roll is being wound on a spindle carried by one pair of arms, and a new core has been mounted in the other pair of arms for transfer of the web thereto.
Figure 3:
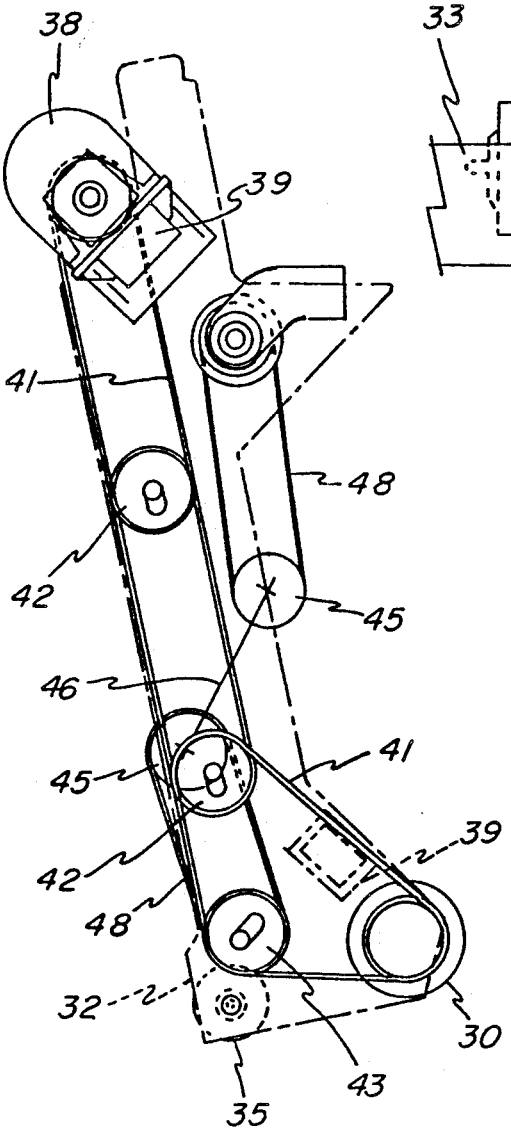
FIG. 3 is a schematic view looking from left to right in FIG. 2 and showing the drive system for the lay-on roll and the other rolls in FIG. 2.

The winder illustrated in the drawings is generally similar in construction to the above-noted U.S. Pat. No. 3,841,577, the disclosure of which is incorporated by reference. It comprises two complementary end stands 10, which are shown as formed of square steel tubing, and the web W to be wound is fed thereto by a pair of driven pull rolls 11 and wraps a roll 12 associated with a tension load cell 13 which forms a part of the drive control system as described hereinafter. Two turret arms 14 and 15, only one of each being shown, are mounted in each stand 10 for rotation with respect to each other about a common axis 16.

As is fully disclosed in U.S. Pat. No. 3,841,577, the respective turret arms 14 and 15 mounted in each end stand are coupled together in pairs through separate indexing drives, which are indicated diagrammatically at 17 and 18, and which can be operated independently of each other. The arms 14 and 15 in each pair are also coupled mechanically by the core shafts that carry the successive cores on which the web material W is wound.

Each such core shaft 20 is keyed or otherwise drivingly connected at each end to the spindle 22 which is mounted in each of arms 14 and 15. In addition, at least one of the arms in each of the resulting pairs is provided with a drive 23 for effecting controlled rotation of the spindles 22 in these arms, each of which is also axially movable in a cylindrical housing 25 on the associated arm in conventional manner to release and grip the ends of the successive core shafts 20.

Figure 4:
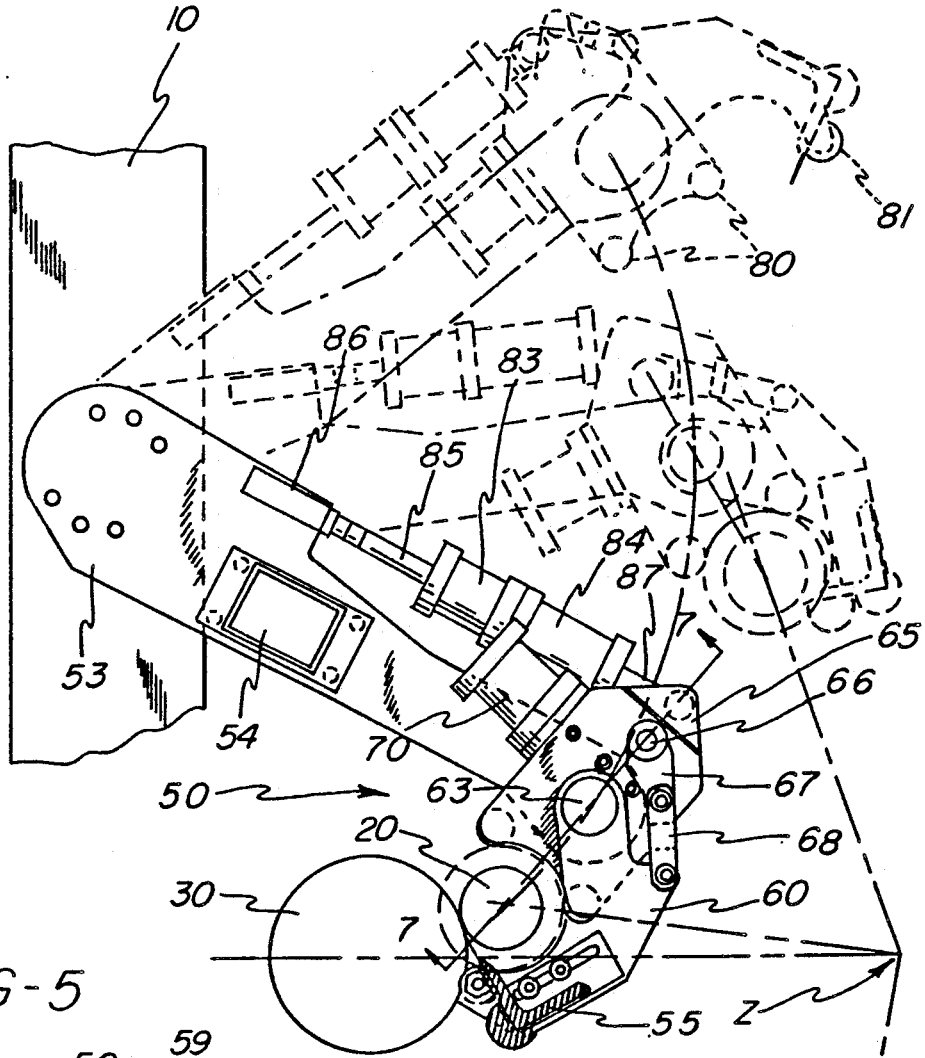
FIG. 4 is a partial side elevation taken as indicated by the line 4—4 in FIG. 6, illustrating the structure and operation of the knife assembly and its supporting structure at the back side of the winder.
Figure 5:
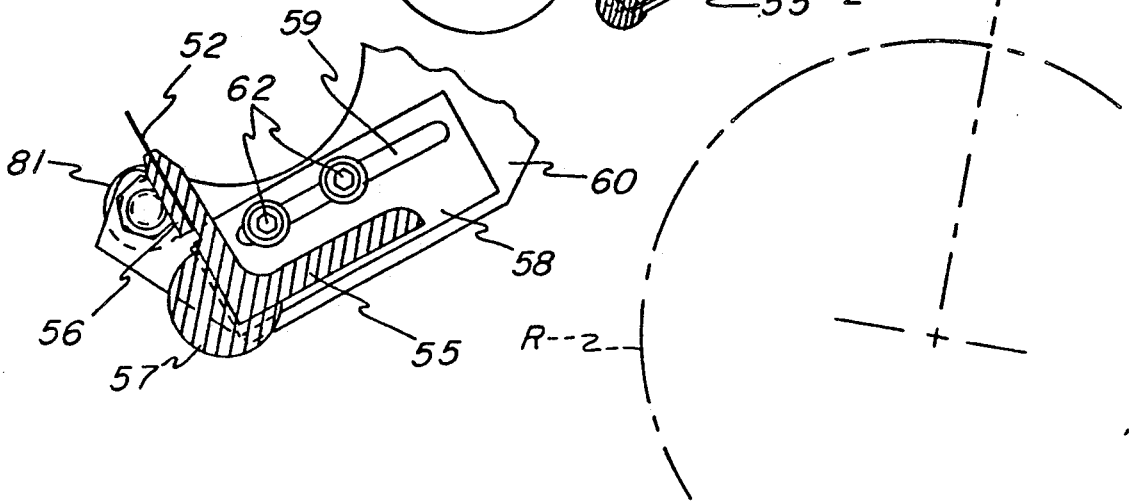
FIG. 5 is an enlarged fragment of FIG. 4.
Figure 6:
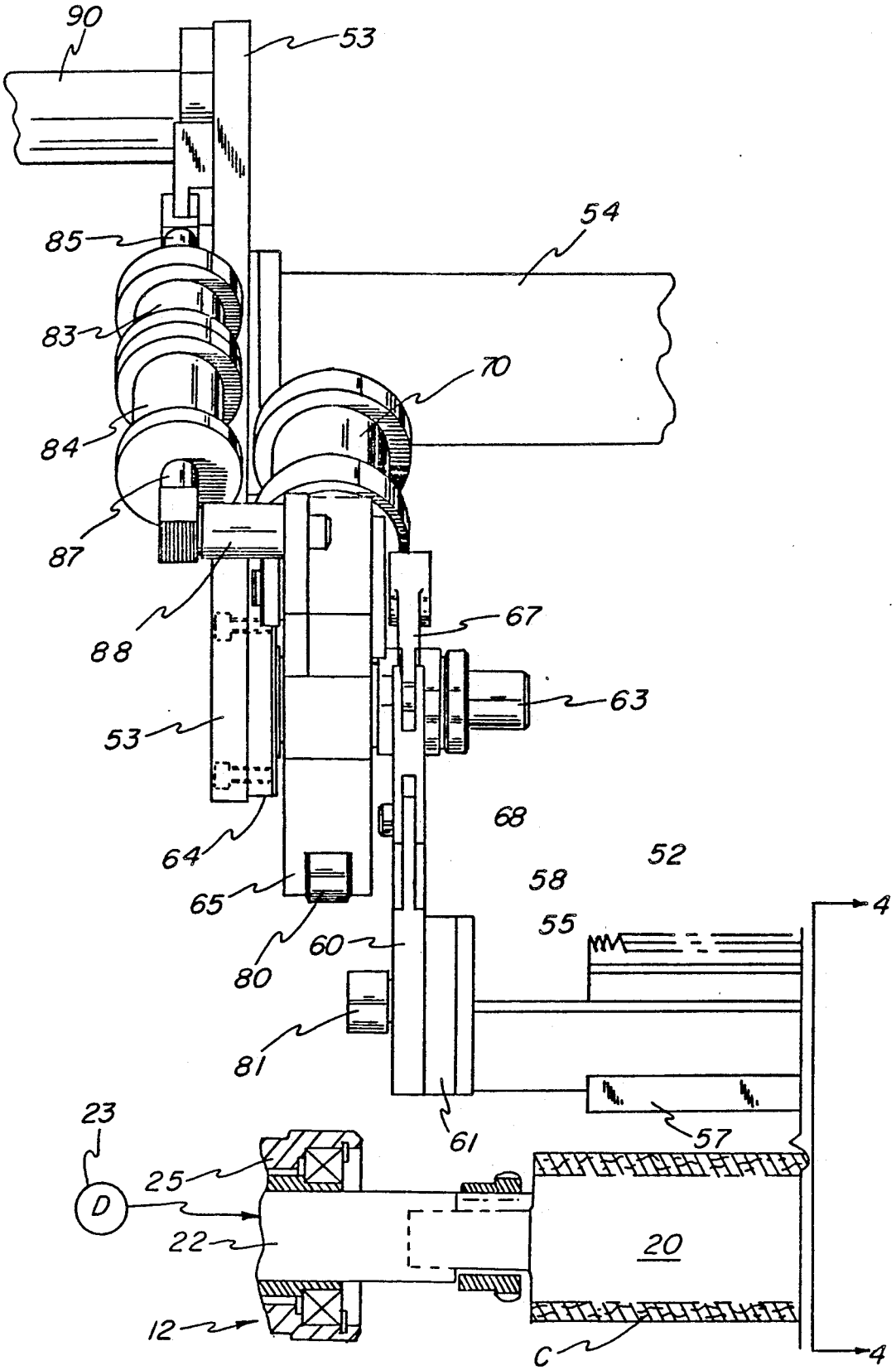
FIG. 6 is a partial view in elevation of the knife assembly and its supporting structure at the front side of the winder looking from right to left in FIG. 4.

As described above, and in more detail hereinafter, FIG. 1 shows the arms 14 in the preferred main winding position wherein they are horizontal and support a winding roll R with its axis in the 9 o'clock position as viewed in FIG. 1, while the arms 15 are in the preferred 3 o'clock position for unloading a full roll R and replacing it with an empty core C. As also described above and hereinafter, the roll changing zone Z is defined by relatively closely spaced angular positions of arms 14 and 15 on either side of 9 o'clock as illustrated in FIG. 4.

A lay-on or rider roll 30 is mounted for relative transverse movement within the winding zone Z towards and away from the successive winding rolls to apply yieldable pressure thereto. This roll 30 is carried by the lower ends of a pair of generally C-shaped arms 32, which are mounted for pivotal movement in brackets 31 depending from a cross beam 33 connecting the end frames 10. A guide roll 34 is rotatably mounted in the arms 32 coaxially with the pivot axis of arms 32, and an additional guide roll 35 is rotatably mounted in the lower ends of arms 32. Each of these arms 32 is continuously biased in counterclockwise direction as viewed in FIG. 1 about its pivotal mounting in the frame by a fluid pressure cylinder 36 connected between it and the cross beam 33 to move the pressure roll 30 toward the axis 16 of the turret arms.

The proportions of the arms 32 are such that the axis about which the roll 30 swings is sufficiently long —e.g. 40 inches —that the movement of the roll 30 in operation, which corresponds to the thickness of each fully wound roll R, does not significantly vary from a straight line. The movements of the pressure roll 30 are therefore confined to the roll-changing zone Z and are essentially toward and away from the turret arm axis 16. A limit position of its movement toward axis 16 is established by a pair of adjustable stops 37 on the cross beam 33 which limit counterclockwise movement of the support arms 32.

Figure 2:
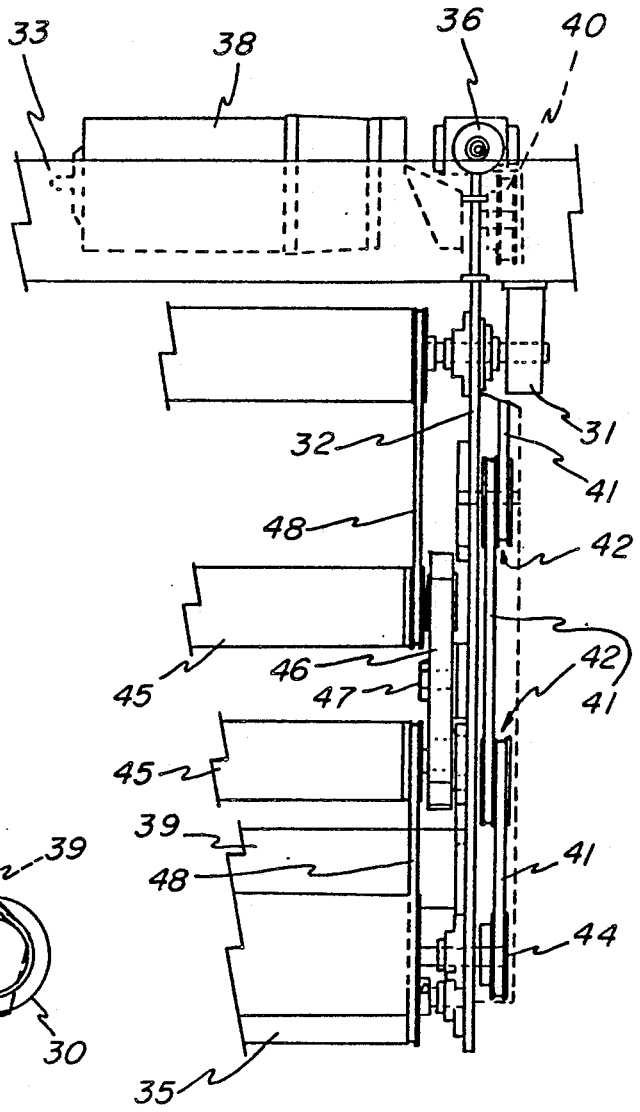
FIG. 2 is a partial view looking from right to left in FIG. 1 and showing the arm assembly which supports the lay-on roll and associated components at the drive side of the winder.

The lay-on roll 30 is provided with a separate drive which, as shown in FIGS. 1–2, comprises a reversible motor 38 mounted at the back side of the winder on the upper of two crossties 39 connecting the arms 32. The drive sprocket 40 on motor 38 is connected through a series of three timing belts 41, intermediate sprockets 42 and a tensioning sprocket 43 with a sprocket 44 on the adjacent journal of roll 30. If it is desired for a given use to drive roll 30 with the web rather than directly, any one of the belts 41 may be removed, but normally the roll 30 will always be driven with enough power to overcome inertia.

The arms 32 also carry a pair of spreader rolls 45 of the bowed type rotatably mounted at the opposite ends of a pair of brackets 46, which are rotatably adjustably secured to the respective arms 32 by a locking bolt 47.

The rolls 45, as well as the rolls 12, 34 and 35, may be free-running rolls driven by the web W of material to be wound, but preferably the spreader rolls are driven by the guide rolls 34 and 35, by belts 48 as shown in FIG. 2.

The winder is illustrated in FIG. 1 as capable of operation with the turret arms 14 and 15 and the successive winding rolls moving in either clockwise or counterclockwise direction. It is accordingly equipped with two knife assemblies indicated generally as 50 and 50', the upper assembly 50 being utilized when the turret arms and rolls rotate counterclockwise, and the lower knife assembly 50' being used when the turret arms and rolls rotate clockwise. Except for the fact that they operate in opposite directions, the knife assemblies 50 and 50' are identical, and the following description is therefore directed to the upper knife assembly 50.

The knife assembly 50 is mounted on the end stands 10 for movement of a knife blade 52 into and out of cutting position between a full roll and a new core carried by the respective pairs of arms 14 and 15. Referring first to FIG. 4, the knife assembly 50 includes a pair of arms 53, only one of which is shown, which are connected by a cross tie 54 and each of which is mounted for pivotal movement through a limited angular range on the associated end stand 10. The mechanism for moving the arms 53 about their common axis is described hereinafter in connection with FIGS. 8–9.

The knife blade 52 is carried by an angle shaped support 55 to which the blade 52 is clamped by bolts and a retainer bar 56. The knife support 55 includes a cylindrically curved boss or bar portion 57 which extends over the major part of its length and serves as a guide for the web in some positions of the parts, and it also includes a bracket portion 58 at each end which has a slot 59 therein. The knife support 55 is in turn adjustably mounted at each end on an arm 60 by a plate 61 and clamp bolts 62 in slots 59 for the purpose of adjusting the operating position of knife blade 52 for cores of different diameters.

Each arm 60 is mounted for pivotal movement on a shaft 63 of generally T-shape having a head 64 which is bolted to the end of the associated support arm 53. Also mounted for pivotal movement on the shaft 63 is a plate 65 which has a relatively deep slot in its upper portion. A freely rotatable short shaft 66 extends across this slotted portion of plate 65 and includes a radially extending arm 67 at its inner end. A link 68 is pivotally connected at its opposite ends to this arm 67 and to the adjacent knife support arm 60. A clamp-type collar on the outer end of shaft 66 secures it to the plate 65.

Figure 7:
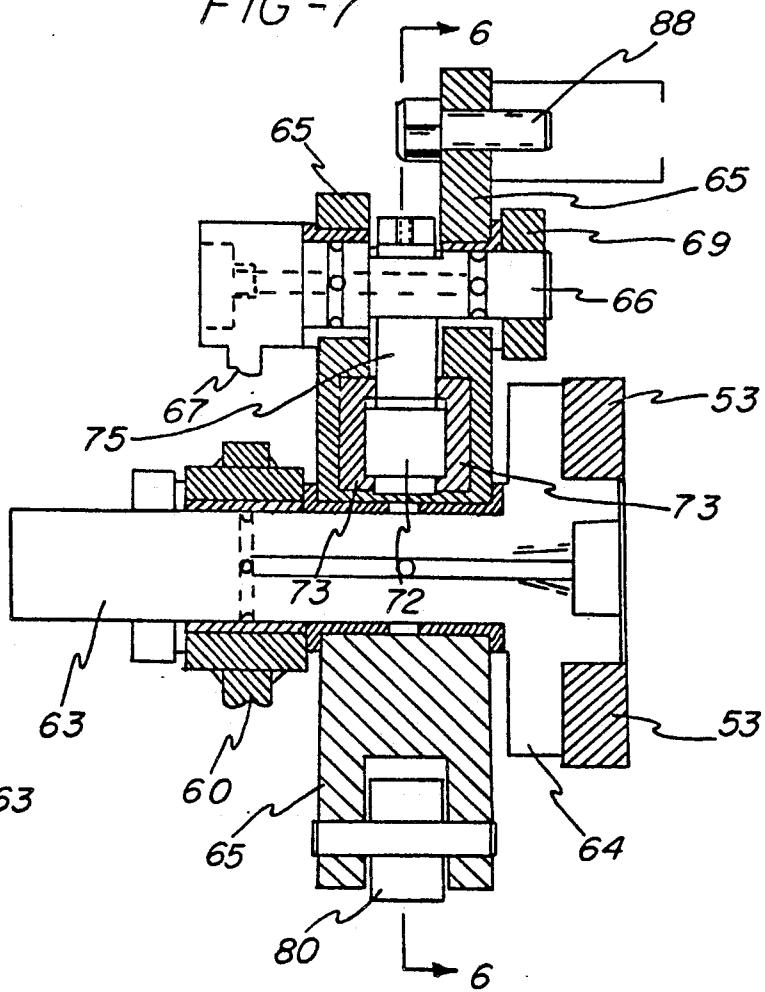
FIG. 7 is a fragmentary section on the line 7—7 in FIG. 4 and on a larger scale.
Figure 8:
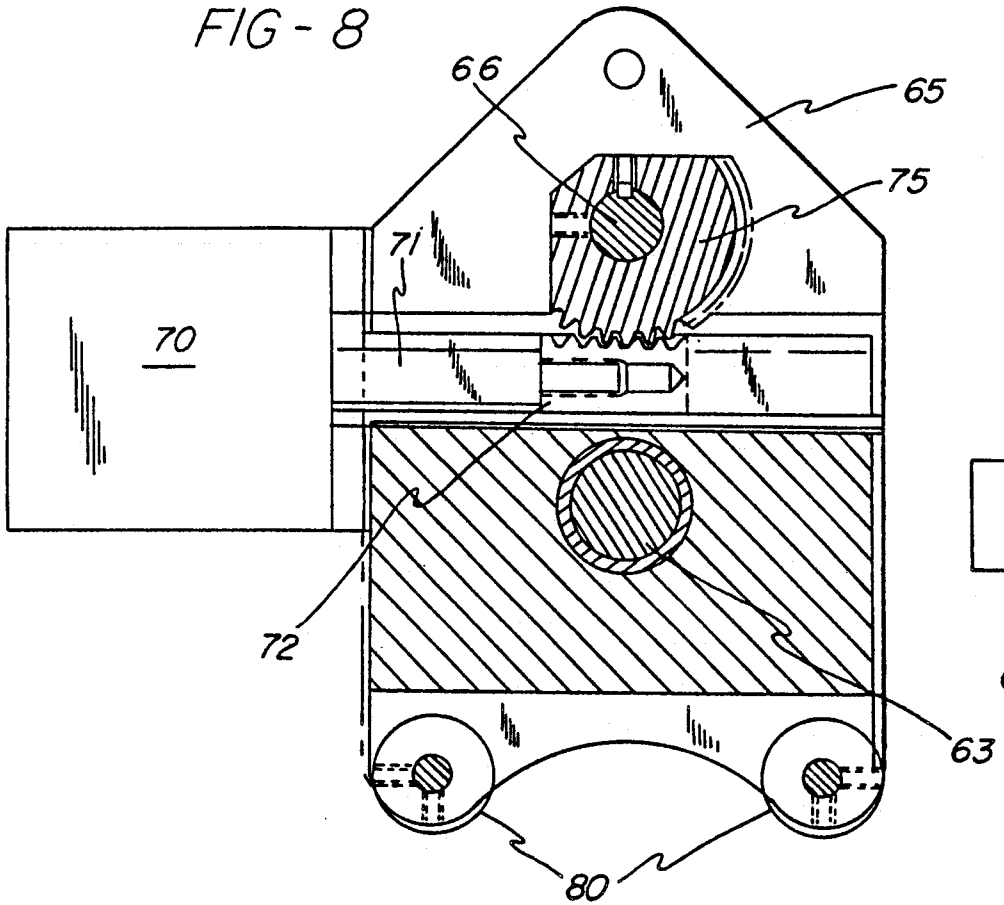
FIG. 8 is a section on the line 8—8 in FIG. 7.

Movement of the knife arms 60 to advance and retract the knife blade 52 on the arms 53 is effected by a pair of fluid pressure cylinders 70, one of which is mounted on the side edge of each of the plates 65. Referring to FIGS. 7 and 8, the piston rod 71 of cylinder 70 has mounted on its outer end a rack 72 of rectangular section which is movable lengthwise in a pair of guides or gibs 73 set in the slotted portion of the plate 65. This rack 72 engages a fragmentary pinion 75 keyed on the shaft 66 so that linear movement of the rack 72 causes rotational movement of the shaft 66, which movement is translated through the arms 67 and links 68 into pivotal movement of the arms 60 on the shafts 63. A satisfactory range for this rocking movement of the shaft 66 has been found to be approximately 93°.

The knife assembly 50 also includes means for effecting a rotatable clamped connection between each of the arms 53 and the associated turret arm 14 or 15 which is carrying a new core during the roll changing operation. More specifically, each plate 65 carries a pair of rollers 80 at opposite corners on its lower side, and for preferred results, the rollers 80 should be anti-friction bearings. An additional similar roller 81 is mounted for free rotation on the end of each of the knife arms 60.

The arrangement and spacing of these rollers 80 and 81 is such that when the knife arms 60 are extended, by the cylinders 70, to locate the knife blade 52 in cutting position, the three rollers 80 and 81 will engage in rotatable clamped relation with the spindle housing 25 on whichever one of the associated arms 14 and 15 is carrying the new core to which the web is to be transferred. In other words, the knife arm 60 and plate 65 at each end of the wire will form a clamped connection to the associated turret arm 14 and 15 in concentric relation with the new core carried by those turret arms, so that during indexing movement of the turret arms in the course of the roll changing operation as described hereinafter, the knife assembly will be moved by the turret arms.

Since the respective radius arms of the spindles 22 and the shaft 66 are fixed, and since the turret arms 14 and 15 and the knife assembly arms 53 are traveling in opposite angular directions, it is necessary that provision be made to adjust the radius arm of the knife assembly while it is clamped to the turret arms. This provision is made by rollers 80 and 81 which enable the plate 65 to rotate around the spindle housing 25. In order to stabilize the knife assembly during such movement, an air spring is connected between each plate 65 and the associated support arm 53 to provide for controlled pivotal movement of each plate 65 on its supporting shaft 60.

More specifically, each air spring comprises two air cylinders 83 and 84 arranged in opposed relation, with the piston rod 85 of cylinder 83 connected to a bracket 86 on the arm 52 while the piston rod 87 of cylinder 84 is pivotally connected to a bolt 88 set in the upper end of the plate 65. Thus while these opposed air cylinders will normally counterbalance each other and thus hold the associated plate 65 in a predetermined position about its supporting shaft 63, they will yield as required when movement of the turret arm to which the plate 65 is clamped requires that the plate 65 pivot in either direction from that predetermined position while the rollers 80 and 81 roll around the surface of the spindle housing 25 to which they are clamped.

Figure 9:
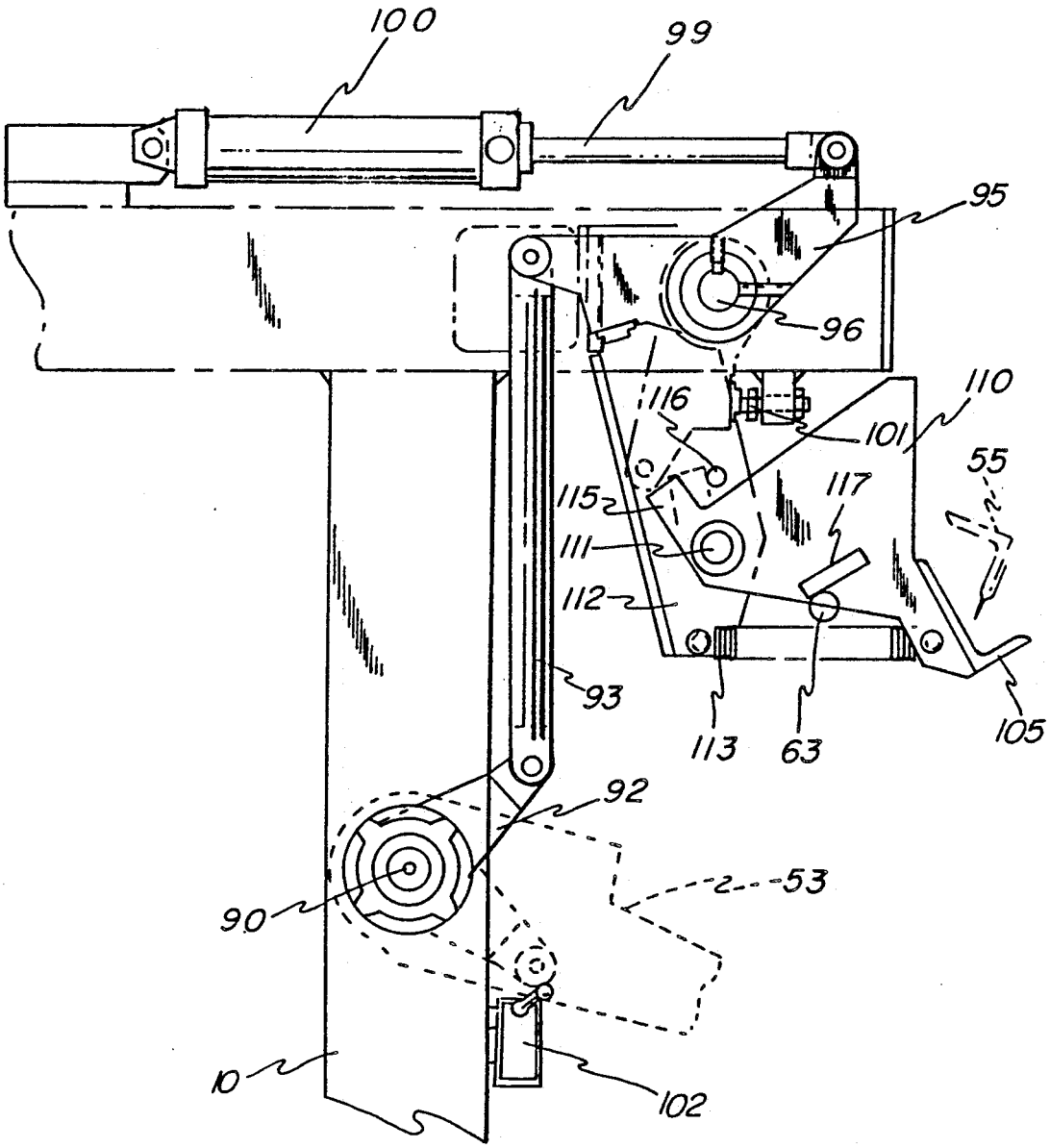
FIG. 9 is a partial side elevation illustrating the mechanism for raising and lowering the upper knife assembly shown in FIGS. 1–8.
Figure 10:
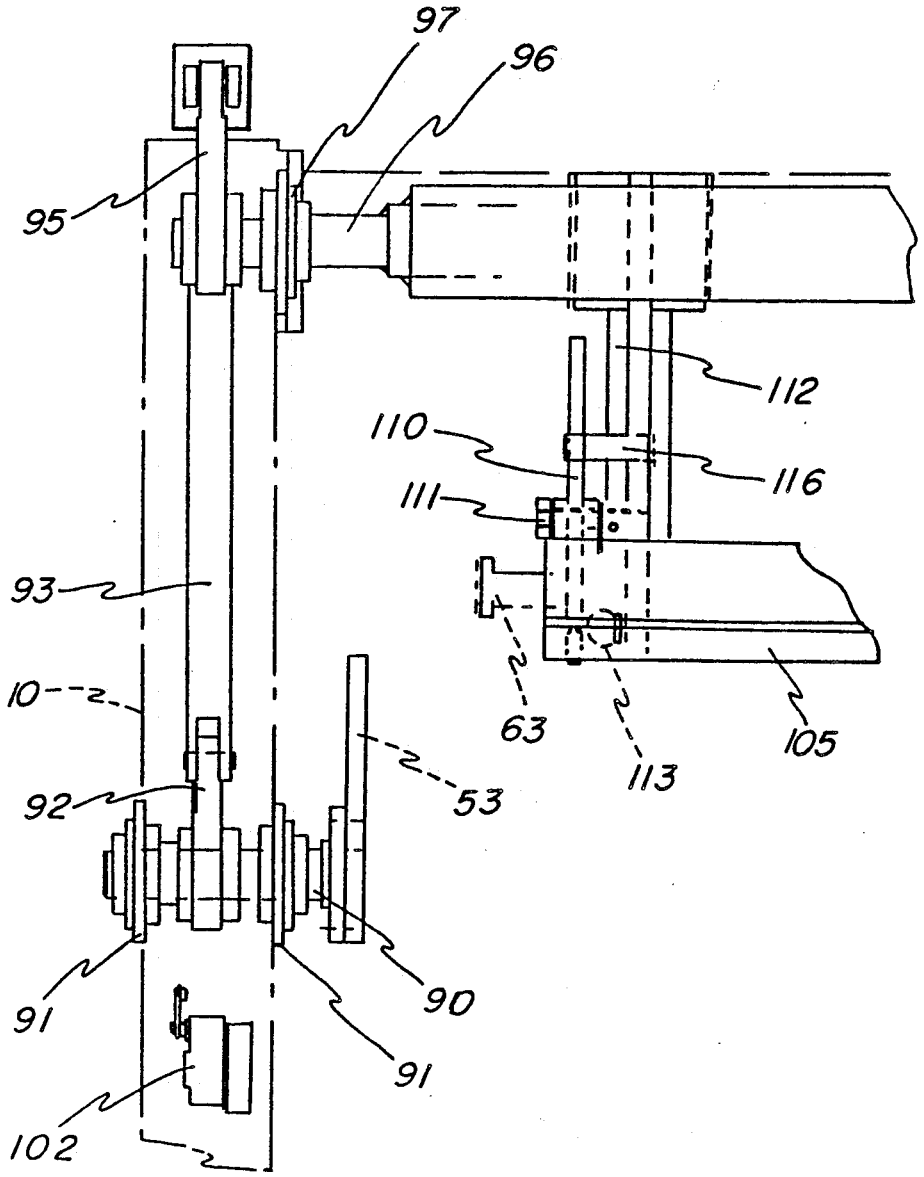
FIG. 10 is a partial view in elevation looking from right to left in FIG. 9.

In the illustrated embodiment of the invention, each of the knife support arms 53 has a total range of 40° of pivotal movement about its mounting on the associated end stand 10, and FIGS. 9 and 10 illustrate the mechanism for effecting and controlling this movement. Each arm 53 is bolted at its pivoted end on the inner end of a shaft 90 rotatably mounted by suitable bearings 91 in the associated end stand 10. A pivot arm 92 is keyed or otherwise fixed on the shaft 90 inside each end stand, and it projects through a slot in the end stand wall and is pivoted to one end of a link 93 having its other end pivoted to one end of a bell crank lever 95 which is keyed on the end of a torque shaft 96 rotatably mounted by bearings 97 in a top portion of the end stand 10. The other end of the lever 95 is pivotally connected to the piston rod 99 of a fluid pressure cylinder 100 pivotally connected to the top of the end stand 10.

FIG. 9 shows the component parts of this mechanism and the positions which they occupy when the knife assembly 50 is in its uppermost position shown in dotted lines in FIG. 4. When the cylinder 100 is operated to retract its piston rod, the lever 95 will rotate counterclockwise, thereby depressing the link 93 and causing the pivot arm 92 to rotate in clockwise direction and thereby to lower the associated knife assembly support arm 53. At the limit of its counterclockwise movement, the lever 95 will engage a stop 101 mounted on the end stand 10, and also the pivot arm 92 will actuate a limit switch 102 mounted on the end stand 10.

Associated with this knife assembly adjustment mechanism is a guard for shielding the knife blade 52 when the knife assembly is in its raised and therefore inoperative position. This guard includes an angle 105 which extends the full width of the winder and is secured at each end to one of a pair of plates 110, each of which is mounted for rocking movement on a pin 111 carried by a bracket 112 depending from the cross beam 34.

The guard plate 110 is normally biased to pivot downward, in clockwise direction, by gravity and by a coil spring 113 connected between it and the bracket 112, with the limit retracted position of plate 110 established by engagement of an arm 115 thereon with a pin 116 set in the bracket 112. The plate 110 is raised, in counterclockwise direction, by the projecting outer end of the shaft 62 in the knife assembly 50, which engages a block 117 on the plate 110 as the knife assembly support arm 53 is raised to its uppermost position. In the resulting positions of the knife assembly and the guard plate 110, as shown in dotted lines in FIG. 8, the angle 105 underlies the edge of the knife blade 52 to minimize the possibility of accidental contact with the knife by operating personnel.

Figure 11:
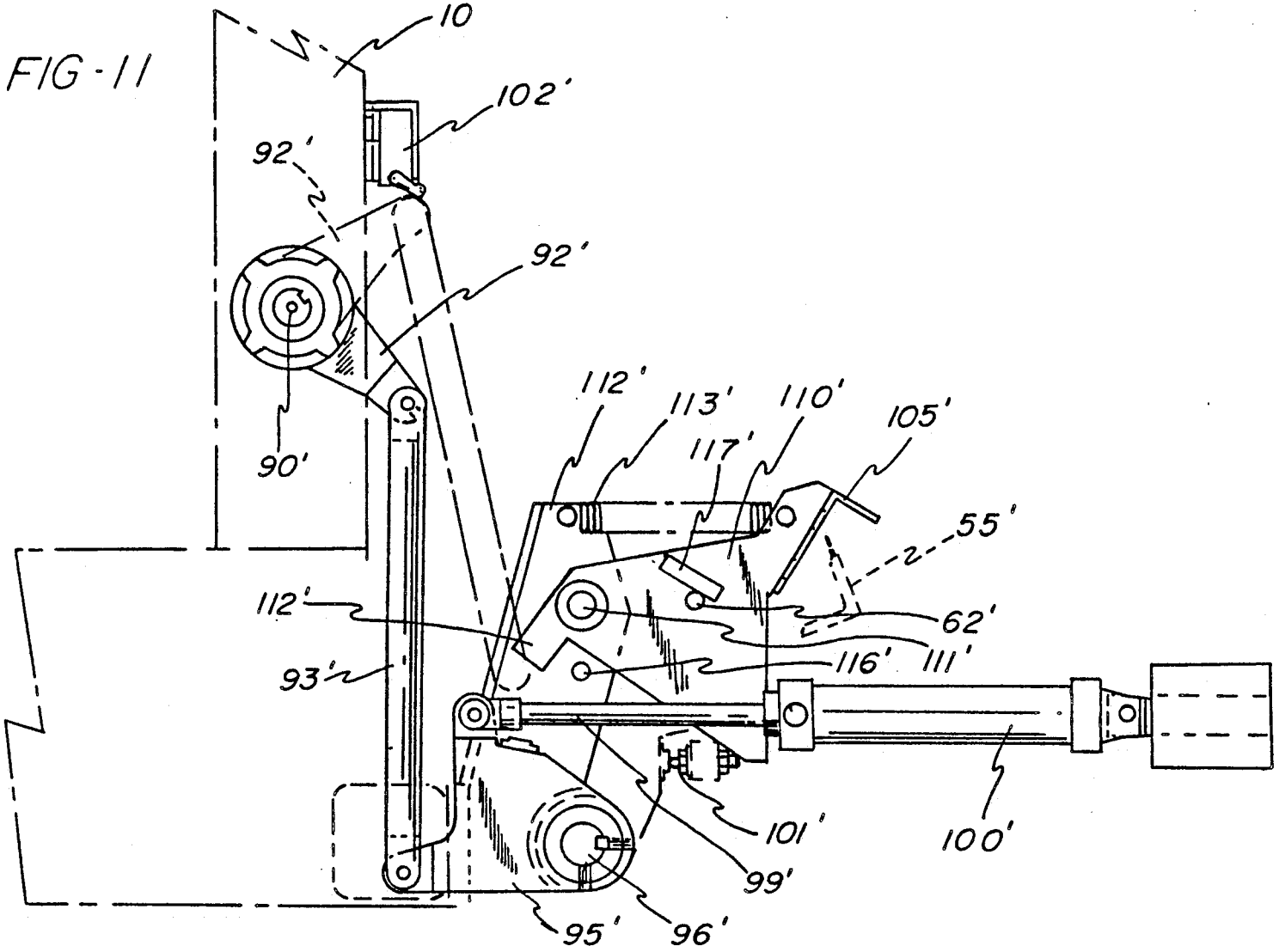
FIG. 11 is a view similar to FIG. 9 showing the mechanism for raising and lowering the lower knife assembly in FIG. 1.
Figure 12:
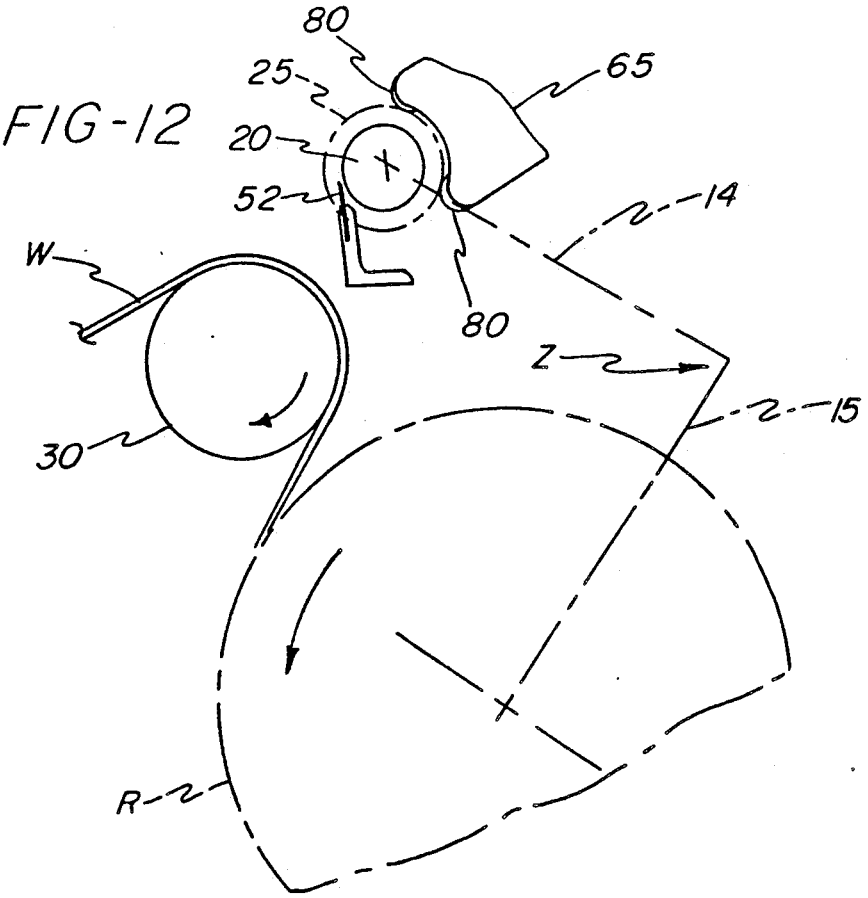
FIGS. 12–14 are fragmentary views on a larger scale illustrating successive stages in the roll changing operation.

As previously noted, the winder shown in FIG. 1 includes a lower knife assembly 50', and FIG. 11 shows the mechanism for moving that knife assembly into and out of operating position. That mechanism is an upside down version of the mechanism shown in FIGS. 9 and 10, and the components thereof are accordingly similarly designated as 90', 92' and so forth. This mechanism operates in the same way as described in connection with FIG. 9 except that the spring 113' lifts the guard plate 110' against gravity to its retracted position for operation of the knife assembly, and it is forced down into its knife-protecting position by the end of the shaft 62 as the knife assembly 50' is moved to its lower, inoperative position.

The operating sequence of the winder is illustrated in FIGS. 1, 4 and 12–14. As previously noted, FIG. 1 illustrates that while a new roll R is being wound on a core supported in the arms 15 with those arms in the horizontal, 9 o'clock position, the arms 14 are moved to the 3 o'clock position where the previously wound roll R is unloaded by a pair of roll lowering arms 120. A new core C is then mounted on the spindles 22 in the respective arms 14, and this is a "prepared" core in that it is provided with a strip 121 of pressure sensitive adhesive extending lengthwise thereof, in the same manner illustrated in the above Tetro Pat. No. 4,422,586. During this part of the operation, both of the knife assemblies 50 and 50' are held in their retracted or rest positions wherein they are out of the path of the roll carried by the turret arms 14.

When the winding roll R supported by the spindle arms 15 is nearing completion, the arms 14 are indexed to a predetermined angular position herein the spindle housings 25 thereon are centered between the arcuate paths of the rollers 80 on the plate 65 at each end of the knife assembly 50. This angular position, in the illustrated embodiment of the invention, is 70° above the horizontal or approximately 11 o'clock, and is the intermediate position shown in FIG. 4, but as noted hereinafter, this angular dimension is subject to variation.

While the arms 14 are in this position, knife assembly 50 is lowered until the rollers 80 engage the spindle housings 25, after which the cylinders 70 are actuated to rotate the knife arms 60 until the rollers 81 thereon complete clamping of the spindle housings 25 by rollers 80 and 81, as shown in FIG. 4. For the balance of the roll changing operation, therefore, the knife assembly 50 remains rotatably clamped to the spindle arms 14 as the latter are indexed to and through the roll changing zone Z.

Up to this point, the roll R continues to wind, and the pressure roll 30 continues to be pressed against its outer surface by the fluid pressure cylinder 36, with the roll 30 being continually pushed away from the winder axis 16 as the diameter of the winding roll R increases. Before further movement of either of the pairs of turret arms, the drive to the spindles in the pair of arms 14 is actuated to bring the core C up to the same surface speed as that of the web and the winding roll R.

The indexing drives for the two pairs of spindle arms are then actuated to cause the two pairs to move together. During this stage, the pressure roll 30 will in effect move around the surface of the winding roll R toward the winder axis 16 until the roll R moves out of engagement with roll 30. At this point, the roll 30 will move inwardly of the roll changing zone Z to the limit position established by the stops 27 for arms 32 wherein it extends into the arcuate path of the new core C on arms 14 and waits for engagement by the core C, as illustrated in FIG. 11.

Figure 13:
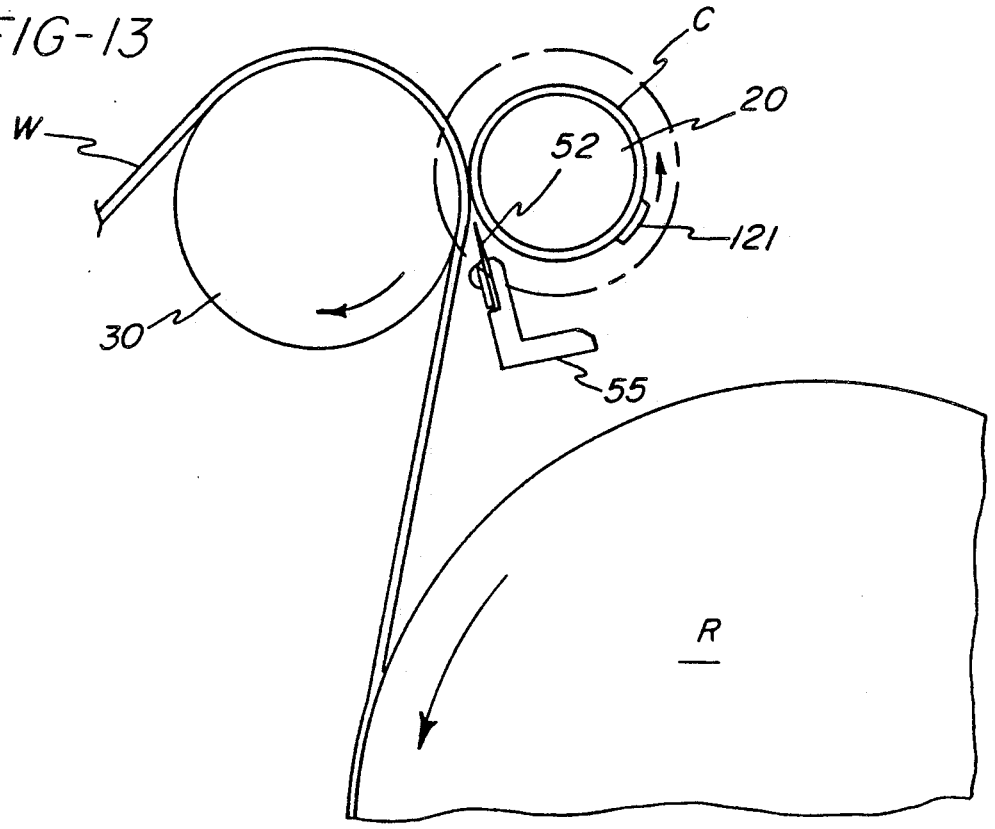
Figure 14:
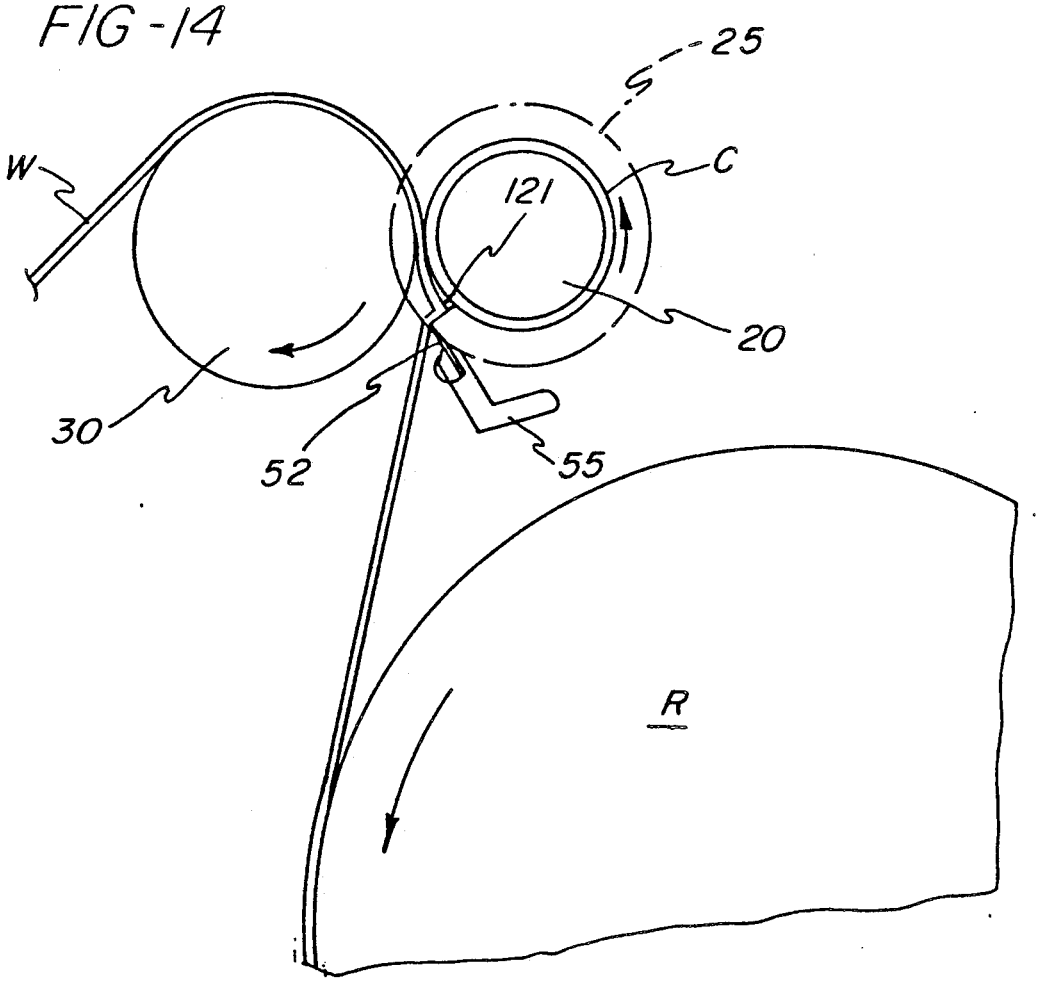

In the illustrated embodiment of the invention, the pressure roll 30 first contacts the core when the turret arms 14 are 7° above the horizontal, and the arms 15 are therefore 63° below the horizontal. With the parts in these relative positions, the edge of the knife blade 52 extends almost to the nip formed by the pressure roll 30 and core C and is therefore only a fraction of an inch away from the surface of the core, as shown in FIG. 13. The web is continuing to travel from the pressure roll to the winding roll R, but as soon as rotation of the core C brings the adhesive strip 121 thereon through the nip with the pressure roll 30, the web will adhere to the core, and will thereby be drawn across the edge of the knife blade, as illustrated in FIG. 14.

The web will therefore be severed, with its leading end adhered to the new core, and while the cut tail extending from the winding roll R is then free, it is so short—e.g. 12 to 18 inches—that it will immediately wind onto the full roll while the latter continues to rotate on the arms 13 as the two pairs of arms continue to index until movement of the arms 14 is stopped when they reach the horizontal position. The arms 15 continue to move, however, to the roll unloading position for the removal of the full roll and its replacement with a new core. Also, the cylinders 70 are reversed to withdraw the knife blade and release the clamping rollers 81, which has to be done very promptly to avoid contact of the new winding roll with the knife. The knife assembly 50 is then raised to its retracted position where it remains until the next roll changing operation.

It will now be seen that in the illustrated embodiment of the invention, the outer limits of the roll changing zones Z are set by the angular relation of the arms 14 and 15 in the position of the upper pair of those arms wherein it becomes attached to the knife assembly 50. A practical factor affecting the angular dimension of the zone is provided by the size of the rolls R to be produced, because it is essential that during the interval of roll changing, there be sufficient space between the full roll and the new core for unclamping of the knife support from the spindle housings 25 as soon as the web has been transferred to the new core and before there has been significant increase in the diameter of the new roll.

This factor is illustrated in FIG. 4 by showing the winder set for production of the largest rolls of which it is capable. In the illustrated embodiment, this maximum diameter is 24 inches, while the core C is shown as only 3.50 inches in diameter, yet the length of the free span of web running from the pressure roll 30 to the roll R immediately prior to roll changing will be only about 18 inches. If the rolls R are to be smaller, the angular spacing between the arms 14–15 at the instant of roll changing could be correspondingly less, provided only that there be sufficient space between the full roll and the newly started roll in which the knife blade and arms 60 can be moved to release the knife assembly from the spindle arms and move the knife blade away from the new roll as soon as the web has been cut.

For any roll size within the capability of the winder, the important advantageous fact is that during the interval wherein the two pairs of arms are indexing simultaneously from the middle position of the upper pair of arms shown in FIG. 4 to the position wherein the core carried thereby first contacts the pressure roll 30, the roll 30 is out of engagement with the winding roll R for an angular interval of only about 35° or less. This represents a time interval of one second or less and a correspondingly short length of tail on the roll R which was not wound under controlled tension and pressure.

In the operation of the winder as described above, the surface of the web W which is on top as it approaches the winder is on the inside as each roll R is wound. If it is desired to have this surface on the inside, then the direction of rotation of the turret arms 14 and 15 is reversed so that they rotate clockwise, the web is led from the guide roll 35 to pass under the pressure roll 30 rather than over it as shown in FIGS. 4 and 12–14, and the knife assembly 55' is utilized during roll changing. The operation of roll changing will take place in the same way as already described, except that the rotational movements of key moving parts will be in the opposite directions from those shown in FIGS. 1, 12–14 with the winding rolls rotating clockwise, the arms 14 and 15 indexing in clockwise direction, the lay-on roll 30 rotating counterclockwise, and the web-severing position of the knife being above the nip of roll 30 with the new core.

In addition to the mechanical advantages provided by the invention as described above, the invention provides winding apparatus having great versatility from the standpoint of the selection and maintenance of optimum tension control conditions for whatever particular web material is being wound, by appropriate interrogation of the separate drives for the pull rolls 11, the spindles 22 and the lay-on or pressure roll 30. For example, in one mode establishing center wind tension control, the web speed will be established by the drive to the pull rolls 11, each winding spindle will be driven at a constantly decreasing angular speed to maintain the winding roll thereon at a constant surface speed which is modulated by the load cell 13 to provide proper winding tension for the web, and the roll 30 will be driven primarily by surface contact with the winding roll, supplemented by only so much of its own drive as is needed to overcome its inertia.

For surface center tension winding conditions, the relationships of the drives for the spindles and lay-on roll will be interchanged, with the roll 30 driven at the proper surface speed modulated by the load cell 13, while the drive to the successive spindles 22 is utilized only to overcome their inertia. Other alternative arrangements will be apparent to those skilled in the art and therefore do not need detailed description.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. Apparatus for continuously winding web material into rolls on successive cores while maintaining said web under substantially constant tension during transfer from a full roll to a new core, and while preventing fold-back of the leading end of said web on each new core, comprising:

(a) a base structure including a pair of spaced opposed end stands, (b) two turret arms mounted in each of said end stands for rotation with respect to each other on a common axis and each including means for rotatably supporting a new core, (c) means coupling said turret arms in opposed pairs, (d) means for selectively indexing each of said pairs of turret arms about said common axis, (e) a rider roll mounted for movement along a predetermined path toward and away from said common axis of said turret arms, (f) means establishing a roll changing zone defined by predetermined angularly spaced positions of said pairs of turret arms on opposite sides of said rider roll path wherein the web is severed from a full roll carried by one of said pairs of turret arms and transferred to a new core carried by the other said pair of turret arms, (g) means for guiding the web between said rider roll and said common axis, (h) yieldable means arranged to bias said rider roll toward said common axis and thereby to press the web against a winding roll or a new core supported within said zone by one of said pairs of turret arms, (i) said indexing means cooperating with said yieldable means to move both of said pairs of turret arms simultaneously in the same direction and thereby to move a full roll supported by one of said pairs of turret arms out of engagement with said rider roll and to move a new core supported by the other said pair of turret arms into engagement with said rider roll with the web therebetween while maintaining both of said pairs of turret arms within said zone, (j) a web cutting knife assembly including a pair of third arms mounted for rotational movement on said base structure about a second common axis parallel with and spaced from said common axis of said turret arms, (k) said knife assembly including a knife blade mounted for movement on said pair of third arms between a retracted position and an advanced cutting position, (l) said knife assembly including means on each of said pair of third arms responsive to movement of said blade to said advanced position thereof for effecting a relatively rotatable connection between said third arm and the adjacent said turret arm, which connection is coaxial with a new core supported in said turret arm, whereby said connected pairs of third and turret arms move together in angularly opposite directions through said roll changing zone, and (m) means for causing said knife to sever the web material at a position within said zone between said full roll and said new core and causing the cut leading end of the web material to wind on said new core.

2. Apparatus as defined in claim 1 wherein said new core has an adhesive surface portion extending lengthwise thereof whereby said rider roll urges the web material into contact with said adhesive surface so that said web material will adhere to said core and thereby be drawn into engagement with said blade and severed thereby as said connected pairs of arms move through said roll changing zone.

3. Apparatus as defined in claim 1 further comprising means pivotally mounting said rotatable connection means (1) on each one of said third arms to said one third arm on an axis parallel with but laterally offset from said new core axis to compensate for said movement of said connected pairs of third and turret arms in arcuately opposite directions.

4. Apparatus as defined in claim 1 further comprising a knife arm pivotally mounted on each of said third arms, means on said knife arms supporting said knife blade for swinging movement therewith about said pivotal mountings thereof between said retracted and advanced positions, and said rotatable connection means (1) including means carried by said knife arms for swinging movement therewith into and out of connected relation with said adjacent turret arm.

5. Apparatus as defined in claim 1 wherein each of said turret arms includes a cylindrical portion coaxial with said means for rotatably supporting a new core, and wherein said rotatable connection means comprises means for forming a rotatably clamped connection between said knife assembly and the outer surface of said cylindrical portion of said adjacent turret arm.

6. Apparatus as defined in claim 5 wherein said means forming said clamped connection comprises a plate mounted for pivotal movement on each of said third arms, a pair of rollers mounted in spaced relation on each said plate for movement with said third arm into engagement with said cylindrical portion of said adjacent turret arm, and a third roller mounted adjacent each end of said knife blade for movement therewith to and from a position cooperating with the adjacent said pair of rollers to effect said rotatable clamped connection with said cylindrical portion of said turret arm.

7. Apparatus for continuously winding web material into rolls on successive cores while maintaining said web under substantially constant tension during transfer from a full roll to a new core, and while preventing fold-back of the leading end of said web on each new core, comprising:

(a) a base structure including a pair of spaced opposed end stands, (b) two turret arms mounted in each of said end stands for rotation with respect to each other on a common axis and each including means for rotatably supporting a new core, (c) means coupling said turret arms in opposed pairs, (d) means for selectively indexing each of said pairs of turret arms about said common axis, (e) a rider roll mounted for movement along a predetermined path toward and away from said common axis of said turret arms, (f) means establishing a roll changing zone defined by predetermined angularly spaced positions of said pairs of turret arms on opposite sides of said rider roll path wherein the web is severed from a full roll carried by one of said pairs of turret arms and transferred to a new core carried by the other said pair of turret arms, (g) means for guiding the web between said rider roll and said common axis, (h) yieldable means arranged to bias said rider roll toward said common axis and thereby to press the web against a winding roll or a new core supported within said zone by one of said pairs of turret arms, (i) said indexing means cooperating with said yieldable means to move both of said pairs of turret arms simultaneously in the same direction and thereby to move a full roll supported by one of said pairs of turret arms out of engagement with said rider roll and concurrently to move a new core supported by the other said pair of turret arms into engagement with said rider roll with the web therebetween while maintaining both of said pairs of turret arms within said zone, and (j) means for severing the web material at a position within said zone between said full roll and said new core to effect a roll change.

8. Apparatus as defined in claim 7 further comprising a pair of rider roll arms pivotally mounted at one end on said end stands, means on the other end of each of said rider roll arms for rotatably supporting said rider roll, a motor mounted on one of said rider roll arms, and transmission means on said one rider roll arm forming a driving connection from said motor for rotation said rider roll.

9. Apparatus as defined in claim 7 wherein said angularly spaced positions of said turret arms which define said roll changing zone are less than 90° apart.

10. Apparatus for continuously winding a web of material into rolls on successive cores, comprising:

(a) means including a rider roll establishing a run of said web traveling to a winding roll, (b) a pair of turret arms mounted for rotational movement about a first common axis parallel with and on the opposite side of said web from said rider roll and each including means for rotatably supporting a new core, (c) means for rotation said turret arms about said axis to swing a core carried thereby through a predetermined arcuate path, (d) means supporting said rider roll for lateral movement thereof toward and away from said axis, (e) means biasing said rider roll toward said axis to a limit position wherein ti interrupts said arcuate path of said core, (f) a web cutting knife assembly including a knife blade carried by a pair of second arms mounted for rotational movement about a second common axis parallel with and spaced on the opposite side of said arcuate path from said first common axis, (g) means on said knife assembly for selectively mechanically coupling said knife assembly to said turret arms whereby said coupled pairs of knife and turret arms are caused to move together in angularly opposite directions toward said rider roll, and (h) means responsive to engagement between said rider roll and said new core with said web therebetween for causing said web to be severed by said knife blade and to wind on said new core.

11. Apparatus as defined in claims 10 wherein each of said turret arms includes a cylindrical portion coaxial with a new core supported in said turret arm, and wherein said mechanically coupling means comprises means for forming a rotatably clamped connection between said knife assembly and said cylindrical portion of said turret arm.

12. Apparatus as defined in claim 1 further comprising means pivotally mounting said mechanically coupling means on each one of said second arms on an axis parallel with but laterally offset from the axis of said mechanically coupling means to compensate for said movement of said coupled pairs of turret and second arms in arcuately opposite directions.

* * * * *

UNITED STATES PATENT AND TRADEMARK OFFICE

CERTIFICATE OF CORRECTION

PATENT NO. : 4,993,652

DATED : February 19, 1991

INVENTOR(S) : Robert F. Moeller

It is certified that error appears in the above-identified patent and that said Letters Patent is hereby corrected as shown below:

On the title page, in item [56]
In the "References Cited": Dreher "4,175,114" should be --4,175,714--.

Claim 3, line 31, the number "(1)" should be the lower-case of capital L --(l)--.

Claim 4, line 42, the number "(1)" should be the lower-case of capital L --(l)--.

Claim 5, line 48, "connection means" should be --connection means (l)--.

Claim 8, line 45, "for rotation" should be --for rotating--.

Claim 10, line 59, "for rotation" should be --for rotating--; line 65, "ti" should be --it--.

Signed and Sealed this

Twenty-eighth Day of July, 1992

*Attest:*

DOUGLAS B. COMER

*Attesting Officer*

*Acting Commissioner of Patents and Trademarks*